US008253668B2

(12) United States Patent
Kim et al.

(10) Patent No.: US 8,253,668 B2
(45) Date of Patent: Aug. 28, 2012

(54) LIQUID CRYSTAL DISPLAY

(75) Inventors: Bum-Jin Kim, Cheonan-si (KR); Seung-Jae Kang, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 854 days.

(21) Appl. No.: 12/394,901

(22) Filed: Feb. 27, 2009

(65) Prior Publication Data

US 2010/0060558 A1 Mar. 11, 2010

(30) Foreign Application Priority Data

Sep. 5, 2008 (KR) ..... 10-2008-0087587

(51) Int. Cl.
*G09G 3/36* (2006.01)

(52) U.S. Cl. ..... 345/87; 345/204

(58) Field of Classification Search ..... 345/87, 345/204

See application file for complete search history.

(56) References Cited

U.S. PATENT DOCUMENTS

| | | | | |
|---|---|---|---|---|
| 6,781,109 | B2 * | 8/2004 | Izumi et al. | 250/214.1 |
| 7,081,908 | B2 * | 7/2006 | Murakawa et al. | 324/527 |
| 7,187,369 | B1 * | 3/2007 | Kanbara et al. | 345/177 |
| 2006/0050042 | A1 * | 3/2006 | Yi | 345/98 |

FOREIGN PATENT DOCUMENTS

| | | | |
|---|---|---|---|
| JP | 2001-194688 | | 7/2001 |
| KR | 100426185 | B | 3/2004 |
| KR | 1020050041355 | A | 5/2005 |
| KR | 1020060077951 | A | 7/2006 |
| KR | 1020070041219 | A | 4/2007 |
| KR | 1020070064733 | A | 6/2007 |
| KR | 1020080003036 | A | 1/2008 |
| KR | 100806906 | B | 2/2008 |
| KR | 1020080012046 | A | 2/2008 |
| KR | 1020080022719 | A | 3/2008 |

* cited by examiner

*Primary Examiner* — Kevin M Nguyen
*Assistant Examiner* — Sepideh Ghafari
(74) *Attorney, Agent, or Firm* — Cantor Colburn LLP

(57) ABSTRACT

A liquid crystal display includes a first insulation substrate, gate lines disposed on the first insulation substrate and extending in a first direction, storage electrode lines disposed on the first insulation substrate and extending in the first direction, data lines extending in a second direction substantially perpendicular to the first direction and intersecting the gate lines and the storage electrode lines and, thin film transistors disposed in pixel areas, pixel electrodes disposed in the pixel areas and connected to the thin film transistors, ripple detecting wiring disposed proximate to a first gate line of the gate lines, a connection line which transmits a ripple signal from the ripple detecting wiring, a ripple detector connected to the connection line, and a ripple compensator which generates a compensation voltage based on the ripple signal received from the ripple detector and applies the compensation voltage to the storage electrode line.

13 Claims, 6 Drawing Sheets

LIQUID CRYSTAL DISPLAY

This application claims priority to Korean Patent Application No. 10-2008-0087587, filed on Sep. 5, 2008, and all the benefits accruing therefrom under 35 U.S.C. §119, the contents of which in its entirety are herein incorporated by reference.

BACKGROUND (a) Field

The present disclosure relates to a liquid crystal display.

(b) Description of the Related Art

Liquid crystal displays ("LCDs") are a type of widely used flat panel display. An LCD includes a pair of panels provided with field-generating electrodes, such as pixel electrodes and a common electrode, and a liquid crystal ("LC") layer interposed between the pixel electrodes and the common electrode. The LCD displays images by applying voltages to the field-generating electrodes to generate an electric field in the LC layer which determines orientations of LC molecules therein to adjust polarization of incident light.

In the LCD, horizontal crosstalk is frequently generated as deterioration occurs. The deterioration in a predetermined pixel is influenced by a neighboring pixel and represents original corresponding luminance due to a coupling effect such that a luminance difference between a portion influenced by the neighboring pixel and a portion which is not influenced by the neighboring pixel is generated.

BRIEF SUMMARY

Exemplary embodiments of the present invention substantially improve horizontal crosstalk of a liquid crystal display to substantially improve a display quality thereof.

The aspects, features and advantages of the present invention may be obtained by exemplary embodiments of the present invention which will be described in further detail herein.

A liquid crystal display according to an exemplary embodiment of the present invention includes: a first insulation substrate; gate lines disposed on the first insulation substrate and extending in a first direction; storage electrode lines disposed on the first insulation substrate and extending in the first direction; data lines extending in a second direction substantially perpendicular to the first direction, intersecting the gate lines and the storage electrode lines and insulated from the gate lines and the storage electrode lines; thin film transistors disposed in pixel areas; pixel electrodes disposed in the pixel areas and connected to the thin film transistors; ripple detecting wiring disposed proximate to a first gate line of the gate lines and intersecting the data lines; a connection line which transmits a ripple signal from the ripple detecting wiring; a ripple detector connected to the connection line; and a ripple compensator which generates a compensation voltage based on the ripple signal received from the ripple detector and applies the compensation voltage to the storage electrode line.

The connection line may be connected to a central portion of the ripple detecting wiring.

The connection line may be disposed on a same layer as the data lines, and may be connected to the ripple detection wiring through a connecting member disposed on a same layer as the pixel electrodes.

The connecting member may overlap at least one data line of the data lines.

The liquid crystal display may further include a first storage voltage supplying line connected to a first end of the storage electrode line and a second storage voltage supplying line connected to a second end, opposite the first end, of the storage electrode line, and disposed on the first insulation substrate, and the ripple compensator may apply a ripple compensation voltage to end portions of the first storage voltage supplying line and the second storage voltage supplying line.

The ripple detecting wiring may include a first ripple detecting wire intersecting the data lines disposed on a left portion of the first insulation substrate and a second ripple detecting wire intersecting the data lines and disposed on a right portion of the first insulation substrate. The ripple detector may include a first ripple detector connected to the first ripple detecting wire and a second ripple detector connected to the second ripple detecting wire, and the ripple compensator may include a first ripple compensator which generates a first compensation voltage based on a first ripple signal received from the first ripple detector and applies the first compensation voltage to the first storage voltage supplying line, and a second ripple compensator which generates a second compensation voltage based on a second ripple signal received from the second ripple detector and applies the second compensation voltage to the second storage voltage supplying line.

The storage electrode line may include a storage electrode disposed substantially parallel to a given data line of the data lines and overlapping the given data line, and an entire width of the given data line is disposed on the storage electrode.

The liquid crystal display may further include a second insulation substrate disposed opposite to the first insulation substrate and a common electrode disposed on the second insulation substrate. The ripple compensator applies the first compensation voltage and the second compensation voltage to the common electrode.

The liquid crystal display may further include a first storage voltage supplying line connected to a first end of the storage electrode line; and a second storage voltage supplying line connected to a second end, opposite to the first end, of the storage electrode line and disposed on the first insulation substrate, wherein the ripple compensator applies a ripple compensation voltage to ends of the first storage voltage supplying line and ends of the second storage voltage supplying line.

The liquid crystal display may further include: a second insulation substrate disposed opposite to the first insulation substrate; and a common electrode formed on the second insulation substrate. The ripple compensator applies the ripple compensation voltage to the common electrode.

In the liquid crystal display, the ripple detecting wiring includes a first ripple detecting wire intersecting the data lines disposed on a left portion of the first insulation substrate and a second ripple detecting wire intersecting the data lines and disposed on a right portion of the first insulating substrate, and the ripple detector may include a first ripple detector connected to the first ripple detecting wire and a second ripple detector connected to the second ripple detecting wire. The ripple compensator may include: a first ripple compensator which generates a first compensation voltage based on a first ripple signal received from the first ripple detector and applies the first compensation voltage to the first storage voltage supplying line; and a second ripple compensator which generates a second compensation voltage based on a second ripple signal received from the second ripple detector and applies the second compensation voltage to the second storage voltage supplying line.

The liquid crystal display may further include a second insulation substrate disposed opposite to the first insulation substrate, and a common electrode disposed on the second insulation substrate. The first ripple compensator and the second ripple compensator apply the first compensation voltage and the second compensation voltage to the common electrode.

In the liquid crystal display, a storage electrode may be disposed substantially parallel to a given data line of the data lines and which overlaps the given data line, and an entire width of the given data line is disposed on the storage electrode.

Thus, in an exemplary embodiment of the present invention, ripple detecting wiring intersecting the data lines is disposed on a liquid crystal panel, and a ripple signal is extracted at a central portion of the ripple detecting wiring and is transmitted to the ripple detector such that an accuracy of a detected ripple is substantially improved, and the ripple is thereby compensated resulting in a substantial reduction of horizontal crosstalk and a corresponding improvement in a display quality of the liquid crystal display.

DETAILED DESCRIPTION

Figure 1:
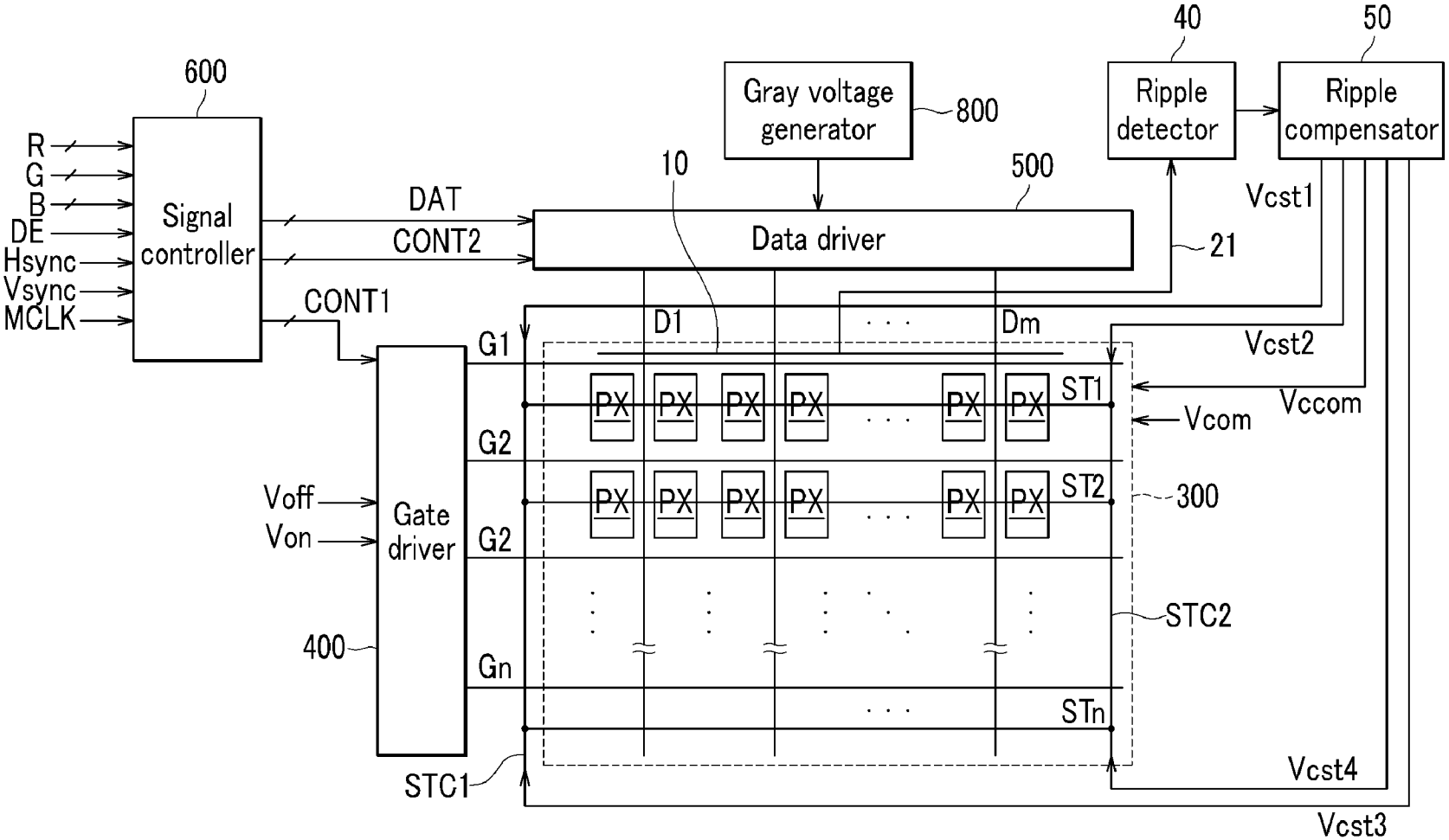
FIG. 1 is a block diagram of an exemplary embodiment of a liquid crystal display according to the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. Aspects, advantages, and features of the present invention and methods of accomplishing the same may be understood more readily by reference to the following detailed description of preferred embodiments and the accompanying drawings. The present invention may, however, may be embodied in many different forms, and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. Thus it will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present invention.

Spatially relative terms, such as "below", "lower", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "lower" relative to other elements or features would then be oriented "above" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be described in further detail with reference to the accompanying drawings. However, the aspects, features and advantages of the present invention are not restricted to the ones set forth herein. The above and other aspects, features and advantages of the present invention will become more apparent to one of ordinary skill in the art to which the present invention pertains by referencing a detailed description of the present invention given below.

A liquid crystal display according to an exemplary embodiment of the present invention will now be described in further detail with reference to FIGS. 1 to 6.

FIG. 1 is a block diagram of an exemplary embodiment of a liquid crystal display according to the present invention.

As shown in FIG. 1, a liquid crystal display according to an exemplary embodiment of the present invention includes a liquid crystal panel assembly 300, a gate driver 400 and a data driver 500 connected thereto, a gray voltage generator 800 connected to the data driver 500, and a signal controller 600 for controlling the abovementioned components. Also, the liquid crystal display according to an exemplary embodiment includes a ripple detector 40 and a ripple compensator 50.

As shown in FIG. 1, the liquid crystal panel assembly 300 includes a plurality of gate lines G1-Gn and a plurality of data lines D1-Dm, and a plurality of pixels PX connected to the plurality of gate lines G1-Gn and the plurality of data lines D1-Dm. The plurality of pixels PX are arranged in a substantially matrix pattern. Also, the liquid crystal panel assembly 300 includes a plurality of storage electrode lines ST1-STn. The plurality of storage electrode lines ST1-STn are disposed substantially parallel to the gate lines G1-Gn. In addition, the liquid crystal panel assembly 300 according to an exemplary embodiment further includes a first storage voltage supplying line STC1 for connecting left end portions of the storage electrode lines ST1-STn (as shown in FIG. 1), and a second storage voltage supplying line STC2 for connecting right end portions of the storage electrode lines ST1-STn (as shown in FIG. 1). Also, the liquid crystal panel assembly 300 includes ripple detecting wiring 10 intersecting the data lines D1-Dm.

The gray voltage generator 800 generates gray voltages, e.g., a predetermined number of gray voltages (or, alternatively, reference gray voltages) related to a desired transmittance of the pixels PX. The gray voltages may include a first set having a positive value with respect to a common voltage Vcom, and a second set having a negative value with respect to the common voltage Vcom.

The gate driver 400 is connected to the gate lines G1-Gn of the liquid crystal panel assembly 300, and applies gate signals, based on a gate-on voltage Von and a gate-off voltage Voff, to the gate lines G1-Gn.

The data driver 400 is connected to the data lines D1-Dm of the liquid crystal panel assembly 300, and selects data signals from the gray voltage generator 800 to apply the data signals to the data lines D1-Dm as data voltages. However, in an exemplary embodiment wherein the gray voltage generator 800 does not supply a voltage for all gray voltages, but instead supplies only a predetermined number of reference gray voltages, the data driver 500 divides the reference gray voltages to generate the data voltages, generates the gray voltages for all grays, and selects the data signal from among the gray voltages divided from the reference gray voltages.

The signal controller 600 controls at least the gate driver 400 and the data driver 500. Specifically, the signal controller 600 according to an exemplary embodiment receives input signals (such as input image signals R, G and B, a data enable signal DE, a horizontal synchronization signal Hsync, a vertical synchronization signal Vsync and a master clock signal MCLK, for example) and controls operation of the gate driver 400 and the data driver 500 by outputting control signals (such as a gate control signal CONT1, an image control signal CONT2 and an image data signal DAT, for example) thereto.

The ripple detector 40 receives a ripple signal from the ripple detecting wiring 10, processes the ripple signal using signal amplification, for example, and transmits the ripple signal to a ripple compensator 50.

Figure 4:
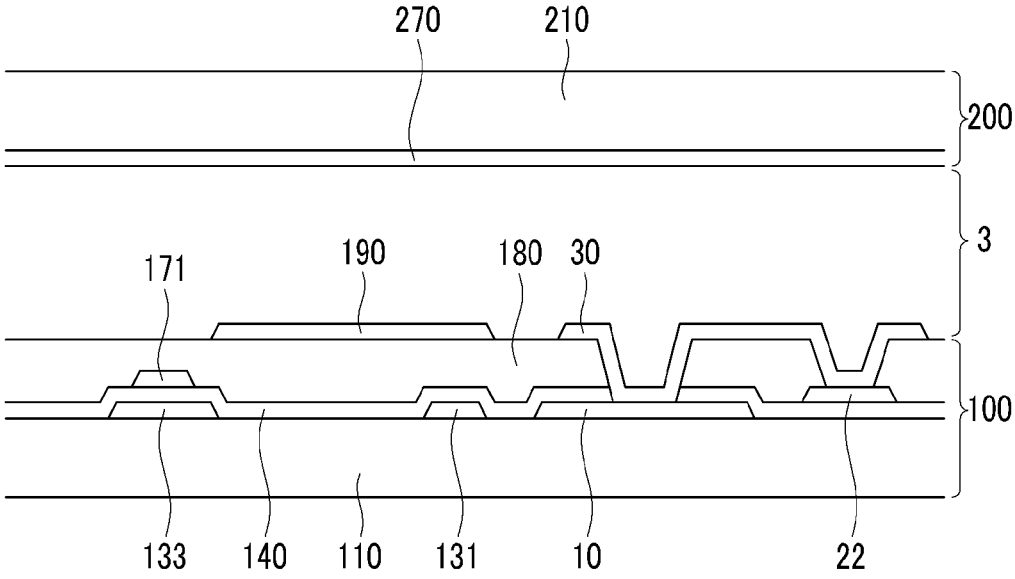
FIG. 4 is a cross-sectional view taken along line IV-IV of FIG. 3.

The ripple compensator 50 generates ripple compensation voltages corresponding to the ripple signal received from the ripple detector 40, and supplies the ripple compensation voltages to terminals of the first storage voltage supplying line STC1, terminals of the second storage voltage supplying line STC2 and a common electrode 270 (FIG. 4). In an exemplary embodiment, the ripple compensation voltages include compensation voltages Vcst1, Vcst2, Vcst3, Vcst4, and Vccom, which are supplied to the terminals of the first storage voltage supplying line STC1, the terminals of the second storage voltage supplying line STC2 and the common electrode 270. In addition each of the compensation voltages Vcst1, Vcst2, Vcst3, Vcst4, and Vccom may have different values from each other.

The ripple detector 40 and the ripple compensator 50 may be included as one circuit, which may be included as a portion of the signal controller 600, but alternative exemplary embodiments are not limited thereto.

Each of the gate driver 400, the data driver 500, the signal controller 600 and the gray voltage generator 800 may be disposed directly on the liquid crystal panel assembly 300 in a form of at least one integrated circuit ("IC") chip. Alternatively, each of the gate driver 400, the data driver 500, the signal controller 600 and the gray voltage generator 800 may be disposed on a flexible printed circuit film attached to the liquid crystal panel assembly 300 in the form of a tape carrier package ("TCP"), or, in an alternative exemplary embodiment, disposed on a separate printed circuit board. Alternatively, the gate driver 400, the data driver 500, the signal controller 600 and the gray voltage generator 800, together with the signal lines G1-Gn, D1-Dm and transistors Q (FIG. 3) may be integrated with the display panel 300. Further, the gate driver 400, the data driver 500, the signal controller 600 and the gray voltage generator 800 may be integrated in a single chip, and at least one of the gate driver 400, the data driver 500, the signal controller 600 and the gray voltage generator 800 or, alternatively, at least one circuit element of the gate driver 400, the data driver 500, the signal controller 600 and the gray voltage generator 800, may be disposed external to the single chip.

Figure 2:
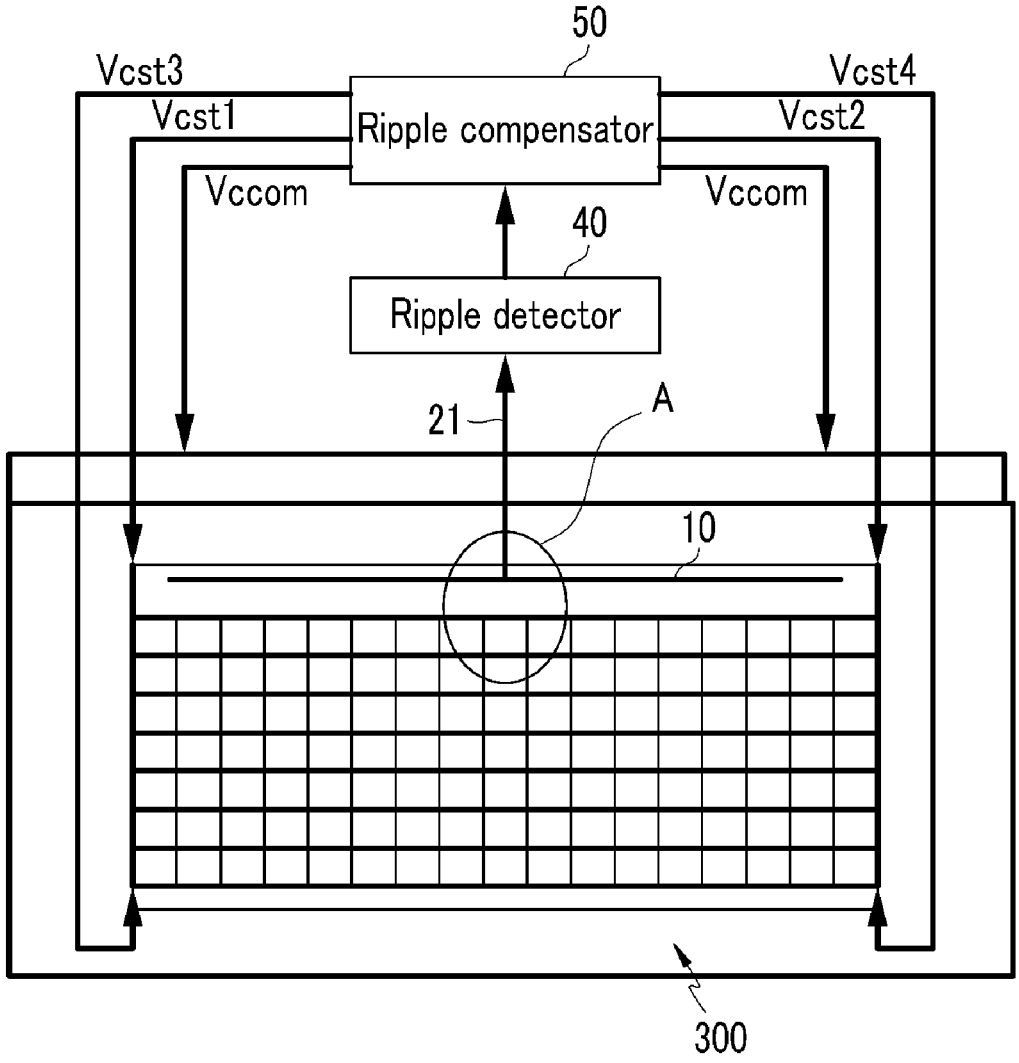
FIG. 2 is a schematic view of an exemplary embodiment of a ripple detecting system in a liquid crystal display according to the present invention.
Figure 3:
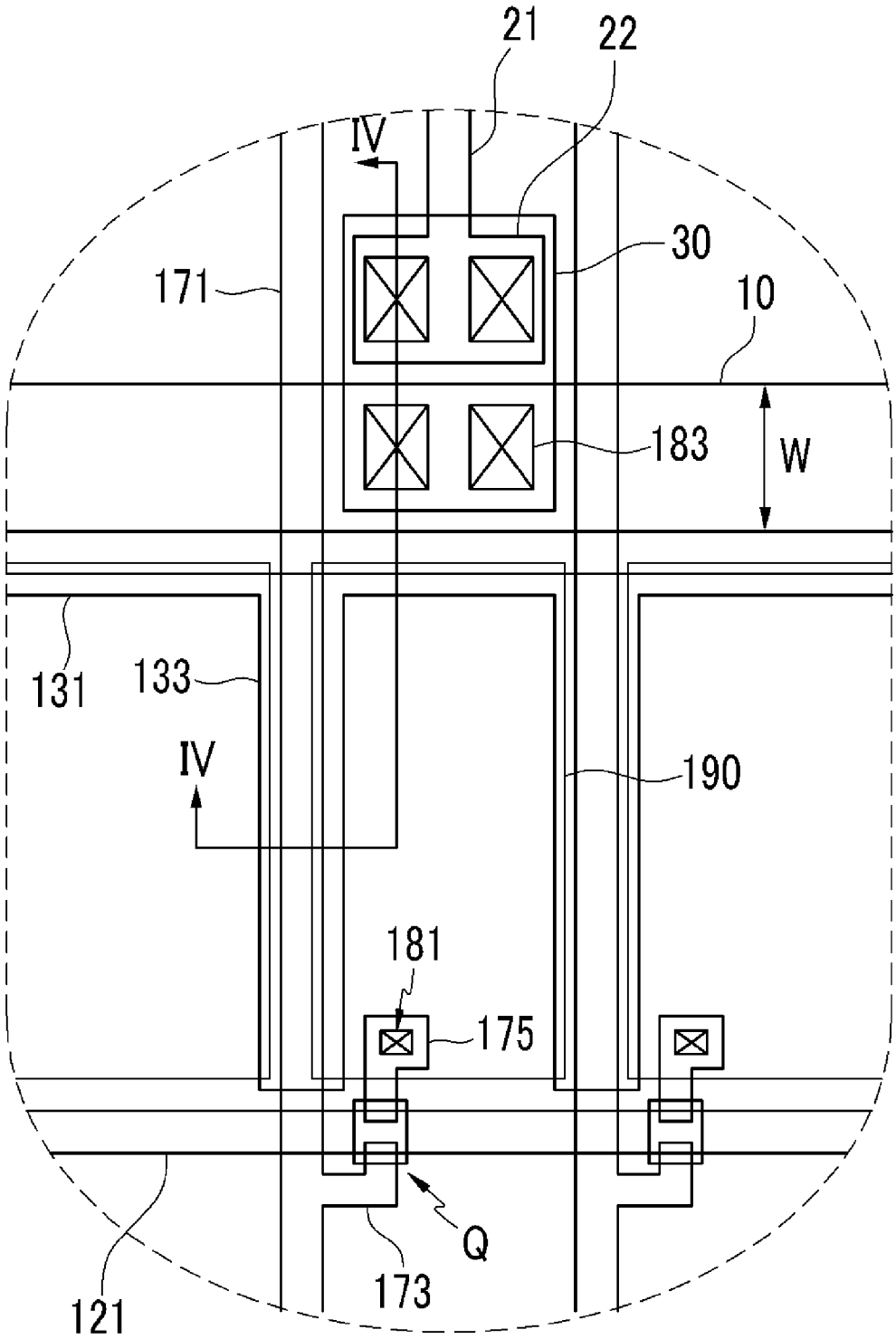
FIG. 3 is an enlarged plan view of region "A" shown in FIG. 2.

FIG. 2 is a schematic view of an exemplary embodiment of a ripple detecting system in a liquid crystal display according to the present invention, FIG. 3 is an enlarged plan view of region "A" shown in FIG. 2, and FIG. 4 is a cross-sectional view taken along line IV-IV of FIG. 3.

Referring to FIGS. 2 and 3, in the liquid crystal display according to an exemplary embodiment of the present invention, the ripple detecting wiring 10 is disposed close to, e.g., proximate to, first gate line G1 on an upper portion of the liquid crystal panel assembly 300 (as viewed in FIG. 1). A ripple signal is transmitted to the ripple detector 40 through a connection line 21 connected to a central portion of the ripple detecting wiring 10, as shown in FIG. 2. The ripple detector 40 receives the ripple signal, and processes the ripple signal using a process such as amplification, for example, and transmits the ripple signal to the ripple compensator 50. The ripple compensator 50 generates the ripple compensation voltages Vcst1, Vcst2, Vcst3, Vcst4 and Vccom, corresponding to the ripple signal received from the ripple detector 40, and supplies the ripple compensation voltages Vcst1, Vcst2, Vcst3, Vcst4 and Vccom to the terminals of the first storage voltage supplying line STC1, the terminals of the second storage voltage supplying line STC2 and the common electrode 270 (FIG. 4).

Accordingly, when the ripple signal is detected in the central portion of the liquid crystal panel assembly 300, an amount of ripple in the liquid crystal display is accurately analyzed for the entire liquid crystal panel assembly 300. Therefore, the liquid crystal display according to an exemplary embodiment includes substantially improved accuracy in a ripple compensation thereof.

The structure of the liquid crystal panel assembly 300 will now be described in further detail with reference to FIGS. 3 and 4.

The liquid crystal panel assembly 300 according to an exemplary embodiment includes a thin film transistor array panel 100, a common electrode panel 200 and a liquid crystal layer 3.

The thin film transistor array panel 100 according to an exemplary embodiment includes an insulation substrate 110 having thin films formed thereon, and the common electrode panel 200 includes an insulation substrate 210 and a common electrode 270 formed thereon. The thin film transistor array panel 100 will now be described in further detail with reference to FIGS. 3 and 4.

A gate line 121, a storage electrode line 131 including a storage electrode 133, and the ripple detecting wiring 10 are disposed on the insulation substrate 110. In an exemplary embodiment, a width W of the ripple detecting wiring 10 is greater than a predetermined value.

A gate insulating layer 140 is disposed on the gate line 121, the storage electrode line 131 and the ripple detecting wiring 10.

A semiconductor 22 is disposed on the gate insulating layer 140, and ohmic contacts (not shown) are disposed on the semiconductor 22.

A data line 171 including a source electrode 173 and a drain electrode 175 are disposed on the ohmic contacts, and on a ripple signal connection line 21. In an exemplary embodiment, the data line 171 overlaps the storage electrode 133, and a width of the storage electrode 133 is greater than a width of the data line 171 such that the entire data line 171 is disposed on the storage electrode 133, as shown in FIG. 3. As a result, a voltage in the storage electrode line 131 is rippled due to swinging signals in the data line 171. Accordingly, the voltage is compensated using the ripple compensation system according to an exemplary embodiment of the present invention, thereby substantially decreasing adverse effects of the rippled voltage, thereby substantially improving a display quality of a liquid crystal display according to an exemplary embodiment.

A passivation layer 180 including contact holes 181 and 183 is disposed on the data line 171, the drain electrode 175 and the ripple signal connection line 21.

A pixel electrode 190 is connected to the drain electrode 175 through the contact hole 181, and a connecting member 30 which connects the ripple detecting wiring 10 and the connection line 21 through the contact hole 183 is disposed on the passivation layer 180. In an exemplary embodiment, the connecting member 30 may be expanded in a substantially horizontal direction to overlap the data line 171. Thus, the connecting member 30 assists the ripple detecting wiring 10 to detect a ripple. Also, the contact hole 183 may include a plurality of contact holes 183 to substantially reduce a contact resistance therethrough.

Figure 5:
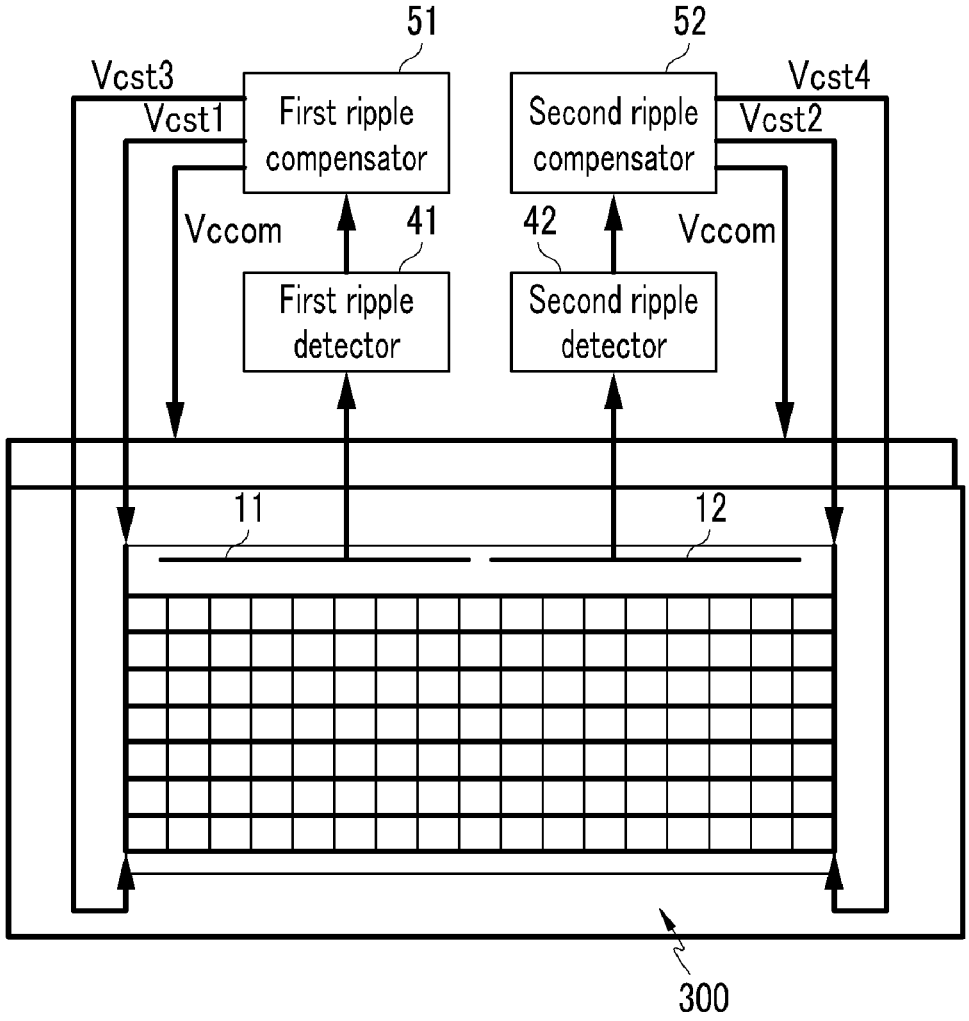
FIGS. 5 and 6 are schematic views of another exemplary embodiments of a ripple detecting system in a liquid crystal display according to the present invention.

FIG. 5 is a schematic view of another exemplary embodiment of a ripple detecting system in a liquid crystal display according to the present invention.

In a ripple detecting system of a liquid crystal display according to an exemplary embodiment shown in FIG. 5, the ripple detecting wiring 10 (FIG. 1) is divided into ripple detecting wires 11 and 12 are provided, and a first ripple detector 41 and a second ripple detector 42 and a first ripple compensator 51, respectively, and a second ripple compensator 52, respectively, are connected to the divided ripple detecting wires 11 and 12, respectively. The first ripple compensator 51 supplies a compensation voltage to terminals of the first storage voltage supplying line STC1 (FIG. 1) and a left portion of the common electrode 270 (FIG. 4), while the second ripple compensator 52 supplies a compensation voltage to terminals of the second storage voltage supplying line STC2 (FIG. 1) and a right portion of the common electrode 270 (FIG. 4). Accordingly, ripple voltages are more accurately detected in a left half and a right half of the liquid crystal panel 300 according to an exemplary embodiment. As a result, ripple compensation is differentiated according to the two detected ripple voltages and is therefore more accurate.

Figure 6:
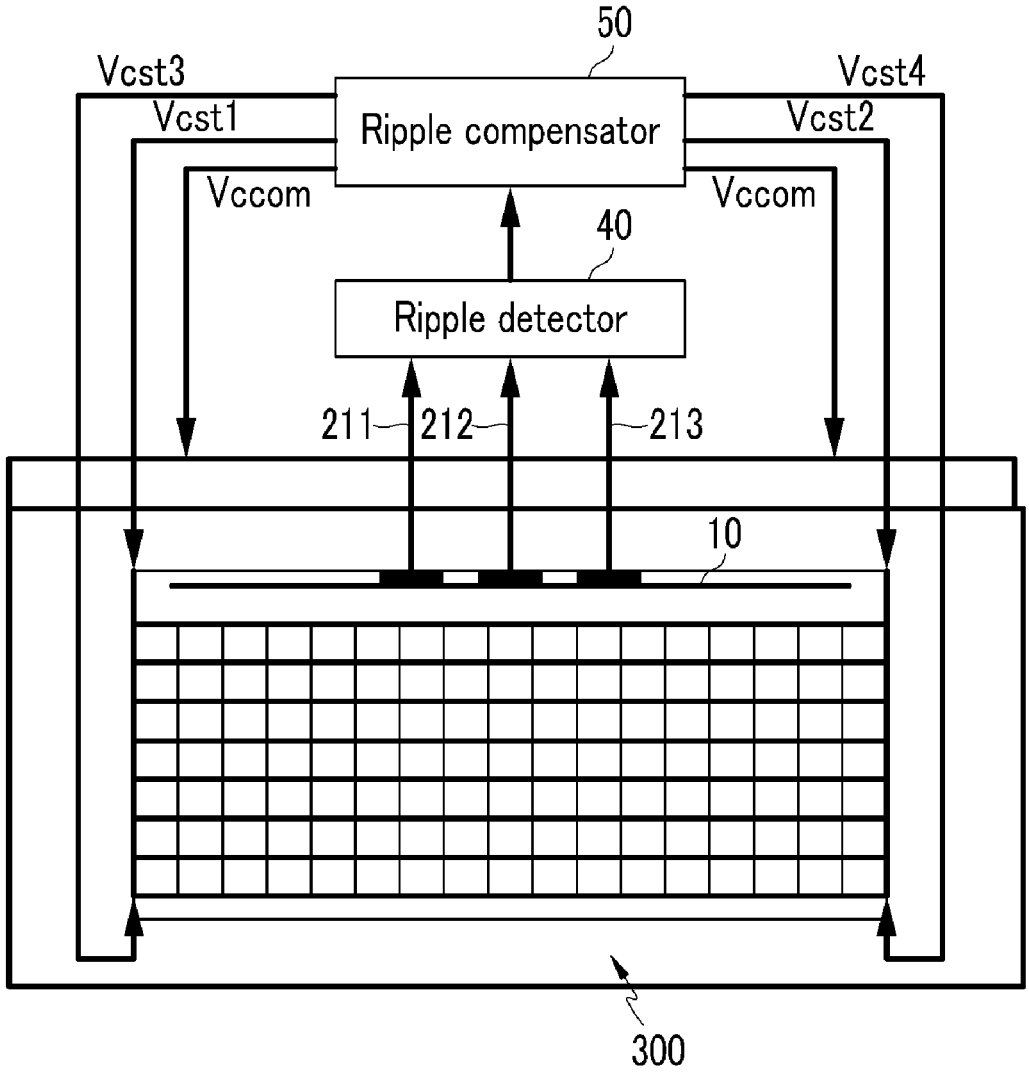

FIG. 6 is a schematic view of another exemplary embodiment of a ripple detecting system in a liquid crystal display according to the present invention.

A ripple detecting system according to an exemplary embodiment shown in FIG. 6 includes a plurality of connection lines 211, 212, and 213 (three are shown in FIG. 6, but alternative exemplary embodiments are not limited thereto) of the ripple detecting wiring 10 compared to the exemplary embodiment of the present invention described in greater detail above with reference to FIG. 1. Thus, a ripple signal is extracted at several portions of the liquid crystal panel 300, such that a ripple signal transmitted to the ripple detector 40 is substantially stronger and also substantially more accurate.

While the present invention has been particularly shown and described in connection with exemplary embodiments thereof, it will be understood by those of ordinary skill in the art that various modifications in form and details may be made therein within departing from the spirit or scope of the of the present invention as defined by the following claims.

What is claimed is:

1. A liquid crystal display comprising:

a first insulation substrate;

gate lines disposed on the first insulation substrate and extending in a first direction;

storage electrode lines disposed on the first insulation substrate and extending in the first direction;

data lines extending in a second direction and intersecting the gate lines and the storage electrode lines and insulated from the gate lines and the storage electrode lines;

thin film transistors disposed in pixel areas;

pixel electrodes disposed in the pixel areas and connected to the thin film transistors;

ripple detecting wiring disposed proximate to a first gate line of the gate lines and intersecting the data lines;

a connection line which transmits a ripple signal from the ripple detecting wiring;

a ripple detector connected to the connection line; and a ripple compensator which generates a compensation voltage based on the ripple signal received from the ripple detector and applies the compensation voltage to the storage electrode line.

2. The liquid crystal display of claim 1, wherein the connection line is connected to a central portion of the ripple detecting wiring.

3. The liquid crystal display of claim 2, wherein the connection line is disposed on a same layer as the data lines, and the connection line is connected to the ripple detection wiring through a connecting member disposed on a same layer as the pixel electrodes.

4. The liquid crystal display of claim 3, wherein the connecting member overlaps at least one data line of the data lines.

5. The liquid crystal display of claim 4, further comprising:

a first storage voltage supplying line connected to a first end of the storage electrode line; and a second storage voltage supplying line connected to a second end, opposite the first end, of the storage electrode line, wherein the first storage voltage supplying line and the second storage voltage supplying line are disposed on the first insulation substrate, and the ripple compensator applies a ripple compensation voltage to end portions of the first storage voltage supplying line and end portions of the second storage voltage supplying line.

6. The liquid crystal display of claim 5, wherein:

the ripple detecting wiring comprises a first ripple detecting wire intersecting the data lines and disposed on a left portion of the first insulation substrate and a second ripple detecting wire intersecting the data lines and disposed on a right portion of the first insulation substrate;

the ripple detector comprises a first ripple detector connected to the first ripple detecting wire and a second ripple detector connected to the second ripple detecting wire; and the ripple compensator comprises:

a first ripple compensator which generates a first compensation voltage based on a first ripple signal received from the first ripple detector and applies the first compensation voltage to the first storage voltage supplying line; and a second ripple compensator which generates a second compensation voltage based on a second ripple signal received from the second ripple detector and applies the second compensation voltage to the second storage voltage supplying line.

7. The liquid crystal display of claim 6, wherein the storage electrode line comprises a storage electrode disposed substantially parallel to a given data line of the data lines and which overlaps the given data line, and an entire width of the data line is disposed on the storage electrode.

8. The liquid crystal display of claim 5, further comprising:

a second insulation substrate disposed opposite the first insulation substrate; and a common electrode disposed on the second insulation substrate, wherein the ripple compensator applies the first compensation voltage and the second compensation voltage to the common electrode.

9. The liquid crystal display of claim 1, further comprising:

a first storage voltage supplying line connected to a first end of the storage electrode line; and a second storage voltage supplying line connected to a second end, opposite to the first end, of the storage electrode line and disposed on the first insulation substrate, wherein the ripple compensator applies a ripple compensation voltage to ends of the first storage voltage supplying line and ends of the second storage voltage supplying line.

10. The liquid crystal display of claim 9, further comprising:

a second insulation substrate disposed opposite to the first insulation substrate; and a common electrode formed on the second insulation substrate, wherein the ripple compensator applies the ripple compensation voltage to the common electrode.

11. The liquid crystal display of claim 9, wherein:

the ripple detecting wiring includes a first ripple detecting wire intersecting the data lines disposed on a left portion of the first insulation substrate and a second ripple detecting wire intersecting the data lines and disposed on a right portion of the first insulating substrate;

the ripple detector comprises a first ripple detector connected to the first ripple detecting wire and a second ripple detector connected to the second ripple detecting wire; and the ripple compensator comprises:

a first ripple compensator which generates a first compensation voltage based on a first ripple signal received from the first ripple detector and applies the first compensation voltage to the first storage voltage supplying line; and a second ripple compensator which generates a second compensation voltage based on a second ripple signal received from the second ripple detector and applies the second compensation voltage to the second storage voltage supplying line.

12. The liquid crystal display of claim 11, further comprising:

a second insulation substrate disposed opposite to the first insulation substrate; and a common electrode disposed on the second insulation substrate, wherein the first ripple compensator and the second ripple compensator apply the first compensation voltage and the second compensation voltage to the common electrode.

13. The liquid crystal display of claim 12, wherein the storage electrode line includes a storage electrode disposed substantially parallel to a given data line of the data lines and which overlaps the given data line, and an entire width of the given data line is disposed on the storage electrode.

* * * * *